US006531984B1

(12) United States Patent
Johannisson et al.

(10) Patent No.: US 6,531,984 B1
(45) Date of Patent: Mar. 11, 2003

(54) DUAL-POLARIZED ANTENNA

(75) Inventors: Björn Johannisson, Kungsbacka (SE); Anders Derneryd, Göteborg (SE); Martin Johansson, Mölndal (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/696,944

(22) Filed: Oct. 27, 2000

(30) Foreign Application Priority Data

Oct. 29, 1999 (SE) ..... 9903920

(51) Int. Cl.[7] ..... H01Q 1/38
(52) U.S. Cl. ..... 343/700 MS; 343/848
(58) Field of Search ..... 343/700 MS, 848, 343/846, 830

(56) References Cited

U.S. PATENT DOCUMENTS

| | | | | |
|---|---|---|---|---|
| 4,903,033 A | | 2/1990 | Tsao et al. | 343/700 MS |
| 5,045,862 A | | 9/1991 | Alden et al. | 343/700 MS |
| 5,241,321 A | * | 8/1993 | Tsao | 343/700 MS |
| 5,471,664 A | | 11/1995 | Kim | 455/323 |
| 5,896,107 A | | 4/1999 | Huynh | 343/700 MS |
| 5,926,137 A | | 7/1999 | Nealy | 343/700 MS |

FOREIGN PATENT DOCUMENTS

| | | |
|---|---|---|
| CA | 2218269 | 4/1999 |
| DE | 198 40 242 A1 | 3/1999 |
| EP | 0 901 185 A1 | 3/1999 |
| FR | 2 666 691 | 3/1992 |
| JP | 6-291503 | 10/1994 |
| JP | 10-209743 | 8/1998 |
| SE | 508 512 | 10/1998 |
| WO | WO 96/08055 | 3/1996 |
| WO | WO98/36470 | 8/1998 |
| WO | WO 98/49741 | 11/1998 |
| WO | WO 99/05754 | 2/1999 |

OTHER PUBLICATIONS

J.R. Sanford and A. Tengs, "A Two Substrate Dual Polarised Aperture Coupled Patch", *Proceedings 1996 IEEE Antennas Propagation Society Symposium*, pp. 1544–1547.
Michael Daoud Yacoub, "Foundations of Mobile Radio Engineering", *CTC Press*, 1993 Ch. 5, pp. 171–212.

* cited by examiner

*Primary Examiner*—Don Wong
*Assistant Examiner*—James Clinger

(57) ABSTRACT

A dual-polarized antenna (10) with good isolation between feed ports (13*a*, 13*b*) and high similarity with respect to the radiation patterns is provided. An antenna (10) includes a patch (11), four symmetrically arranged feed structures (12*a*–12*d*, 15), two feed ports (13, 13*b*) and a feed network (14). Radiation pattern similarity is obtained by the pair-wise symmetrical, orthogonal layout of the feed structures (12*a*–12*d*, 15). Good isolation between feed ports (13*a*, 13*b*) is achieved through a feed network (14) divided into two network parts (14*a*, 14*b*) where each network part (14*a*, 14*b*) is designed so that each coupling between a network part (14*a*, 14*b*) and a feed structure (12*a*12*d*, 15) belonging to the other polarization is cancelled by a mirrored coupling with the other feed structure (12*a*–12*d*, 15) belonging to the polarization. In addition, a network part (14*a*, 14*b*) is laid out so that its corresponding feed structures (12*a*–12*d*, 15) are fed with supporting signals of equal magnitude.

35 Claims, 4 Drawing Sheets

DUAL-POLARIZED ANTENNA

This application claims priority under 35 U.S.C. §§119 and/or 365 to 9903920-8 filed in Sweden on Oct. 29, 1999; the entire content of which is hereby incorporated by reference.

TECHNICAL FIELD OF THE INVENTION

This invention relates to the technical field of antennas, and more specifically to dual-polarised antennas.

DESCRIPTION OF RELATED ART

Historically, the most common diversity technique, especially in mobile communications, has been space diversity. In this diversity technique two or more antennas are placed apart from each other, separated by a distance that is a function of the wavelength the antennas should receive or transmit. On uplink the incoming signals received at each antenna are combined in an optimum way so as to maximise the quality of the resulting signal.

Owing to economical as well as aesthetical reasons, base stations are nowadays increasingly equipped with a single dual-polarised antenna, or one such antenna for each sector or frequency band. Such an antenna must provide two at least mainly orthogonal polarisation directions in order to enable the use of diversity techniques. This is possible, as orthogonally polarised waves are essentially uncorrelated in a multipath environment.

Good transmission and reception characteristics are obviously important in antennas. For dual-polarised antennas, these characteristics are among other things affected by isolation between the antenna's feed ports, and by the farfield pattern characteristics. Good isolation between feed ports is much more difficult to obtain in a dual-polarised antenna than in a pair of space diversity antennas as the latter are located a distance apart from each other.

The isolation problem is easier to describe if an antenna is considered as analogous to a four-port. Two of the four ports represent actual transmission line feed ports; one for each of the two desired orthogonal polarisations. The other two ports are virtual ports representing, on transmit, radiated power in each of the two orthogonal polarisations, integrated over an arbitrary sphere enclosing the antenna. Thus, on transmit, the antenna has two input ports (feed ports) and two output ports (radiated power). Similarly on receive the antenna has two input ports (received power) and two output ports (feed ports). Note the the same feed ports are used for both transmission and reception. The antenna, and its four-port representation, is reciprocal.

The scattering parameters of a four-port are often represented by the S-matrix, a four-by-four matrix. The S-matrix for an ideal dual-polarised antenna has four non-zero values all of unit magnitude. These values represent the forward and backward coupling between corresponding input and output ports.

Isolation between ports is never perfect in practice. This leads to a certain degree of mutual coupling. From a system point of view, the study of mutual coupling effects can be limited to two categories: isolation between the feed ports and coupling between feed port and undesired output port. Isolation between feed ports is primarily a problem on tranmit while coupling between feed ports and undesired output ports is primarily a problem on receive.

Isolation between feed ports is of primary importance in the transmit direction, i.e. in the downlink band for mobile telecommunication. In a base station antenna, transmitted power is many orders of magnitude greater than received power. It is therefore important to stop transmitted signals from leaking into the received signal paths. This is achieved with filters, and the worse the mutual coupling between feed ports the worse the leakage and the better the filters have to be. Better filters, which give better suppression, are as a rule more expensive and unwieldy. On the other hand, reduced mutual coupling between feed ports enables the use of simpler and less expensive filters.

Mutual coupling between feed ports can also cause problems when the transmitted signal from one port travels "backwards" via the other transmit branch. This may give rise to intermodulation effects and spurious radiation, both in the uplink and downlink frequency bands.

Coupling between a feed port and undesirable output port will result in polarisation impurities. On receive the impurities may increase the correlation between the received signals, which in turn diminishes the diversity gain potential. The similarity between the angular power distribution of the radiation patterns for the two polarisations will also affect the attainable diversity gain. In general, the more alike the radiation patterns of the two polarisations are, the better the antenna will be from a polarisation diversity point of view. Furthermore, equal patterns for both polarisations are important on both uplink and downlink in order to cover the same angular and radial region.

There are a number of factors that adversely affect the polarisation purity and the mutual coupling of an antenna. The finite size of the antenna will give rise to both of the above owing to edge and corner diffraction. The antenna may consist of one, two or more primary radiators (antenna elements). Dual-polarised primary radiators also generate mutual coupling and polarisation impurities. This is owing to asymmetries in both the radiating elements and the feed network. Mutual coupling can also be caused by the proximity of the element feed points.

Several attempts have been made to overcome these problems with dual-polarised antenna elements. Some of these attempts will be described below.

A common type of dual-polarised antenna element is the aperture-coupled microstrip patch antenna. By feeding a patch using orthogonal slots (apertures) the antenna is made to simultaneously radiate and/or receive two orthogonally polarised waves. Similar characteristics can be achieved by using probe-fed patches, but the aperture-coupled patch is superior to the probe-fed patch from a bandwidth, passive intermodulation and manufacturing point of view and is the dominant type in use today for communication applications.

U.S. Pat. No. 4,903,033 presents a dual-polarised antenna that involves an air bridge to accomplish a symmetric feed arrangement in both of the polarisation branches, while Sanford, J. R. and Tengs, A.: "A Two Substrate Dual-Polarised Aperture-Coupled Patch", Proceedings 1996 IEEE Antennas Propagation Society Symposium, present an antenna where symmetry is achieved by placing the feed networks on opposite sides of a dielectric substrate, with the feed slots de-embedded in the centre of the substrate. Both solutions involve feed network layouts that make the dual-polarised patch element more complex than a single polarised element. Furthermore, neither of the two solutions is truly symmetric. Mutual coupling, primarily between the two crossing feed arms, will introduce asymmetries in the excitation current. These asymmetries can only be compensated for at one or a few frequencies, if at all.

U.S. Pat. No. 5,045,862 presents a microstrip array arrangement useful for reception with a high degree of symmetry. This single layer arrangement consists of interconnected etched square patch elements and filters. These elements and filters make up a square periodic grid, in two orthogonal directions. Each patch is connected to its four neighbouring patches by symmetric feed lines extending from the centre of the four sides of the patch element. While this arrangement is truly symmetric, it is not useful for communication applications for a number of reasons. For example, radiation may occur from feed lines, filters, and matching stubs when using one side of the dielectric layer, and the coupling between polarisations is not suppressed by the feed arrangement.

WO 98/49741 proposes a compact and simple feed solution, see FIG. 1. A single layer feed-network design is utilised with a combination of a symmetrical and an asymmetrical feed arrangement. This solution can only be used to obtain a two-port antenna element with good isolation properties at one or a few frequencies. Nor does the design allow for simultaneous symmetrical slot feed for both polarisation ports.

For the reasons stated above it is desired to find a dual-polarised antenna element with improved transmission and reception characteristics.

SUMMARY OF THE INVENTION

The present invention aims to solve the problem of how to improve transmission and reception characteristics in dual-polarised antennas.

One object of the present invention is to provide a dual-polarised antenna element for which the transmission and reception characteristics are improved owing mainly to the layout of the feed network.

Another object of the present invention is to provide a layout of a feed network for a dual-polarised antenna in order to reduce or cancel undesired effects from one part of the network to another and vice versa.

Yet another object is to provide a method for feeding current to two orthogonal polarisations in a dual-polarised antenna element.

Still another object is to provide a method for obtaining a dual-polarised antenna element of the above-mentioned kind.

According to the present invention, there is provided a dual-polarised antenna where the effect of the signals feeding one polarisation, on the other polarisation, is cancelled owing to the layout of the lines through which the signals are fed.

According to the present invention, there is provided a method for feeding current to two orthogonal polarisations in a dual-polarised antenna element so that the effect of the current on the other polarisation is cancelled owing to the layout of the lines through which the signals are fed.

According to the present invention, there is also provided a method for obtaining a dual-polarised antenna element of the above-mentioned kind.

The apparatus according to the invention is defined in claim 1.

Preferred embodiments of the apparatus according to the invention are defined in claims 2–24.

The first method according to the invention is defined in claim 25.

The second method according to the invention is defined in claim 26.

Preferred embodiments of the second method according to the invention are defined in claims 27–35.

An advantage with the present solution to the problem is that the port isolation in the dual-polarised antenna is improved.

Another advantage with the present solution to the problem is that the similarity of the dual-polarised antenna's patterns of the two polarisations is increased.

The invention will now be described in more detail with the aid of the description of the embodiment and with reference to the drawings.

DETAILED DESCRIPTION OF EMBODIMENTS

Figure 1:
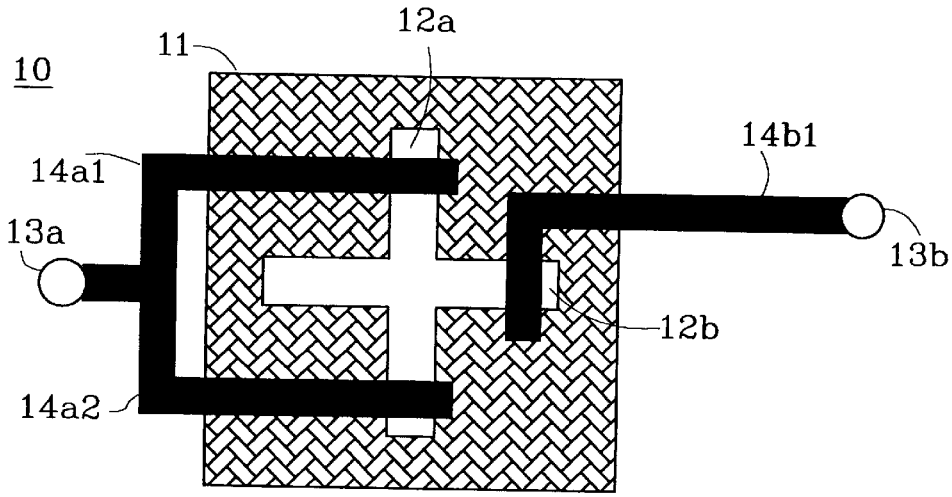
FIG. 1 shows an example of an existing feed network found in prior art.

FIG. 1 shows an example of a prior art dual-polarised microstrip antenna (WO 98/49741). An antenna element 10 comprises a patch 11 and two orthogonal slots 12*a*, 12*b* as feed structures. Two ports 13*a*, 13*b*—one for each polarisation—are the sources for the feed network 14. Port 13*a* is connected to network part 14*a* that bifurcates into branches 14*a*1 and 14*a*2. Each of these branches 14*a*1, 14*a*2 cross the vertical slot 12*a*, one on each side of slot 12*b*. Port 13*b* on the other hand is connected to another network part 14*b*1. This second network part 14*b*1 intersects slot 12*b*.

As can be seen from FIG. 1, slot 12*b* is not fed symmetrically. The design does not allow for simultaneous symmetrical slot feed for both polarisation ports. This leads to polarisation impurities.

One way of improving port isolation is to arrange and exploit symmetries in the feed network. The resulting current symmetries will also generate similar patterns for the two orthogonal polarisations.

A first concern when designing the feed network is to mitigate the coupling effects. Placing any two transmission lines as far from each other as possible is a way of doing this. Transmission line losses must however also be taken into account. In addition, discontinuities, e.g. bends, in the transmission lines should preferably be avoided. When such discontinuities are unavoidable, the layout should be chosen so that as little spurious radiation as possible should be radiated by them.

One way of eliminating the mutual coupling effects is to choose the feed network layout so the mutual coupling effects of individual coupling contributions cancel each other when summed over all components. This is achieved by having each feed line with a certain current (or voltage) matched with an identical mirror-imaged second line with the identical current and amplitude as the first line. This latter current should either be in-phase or 180 degrees out-of-phase, depending on the layout, when compared to the first current.

Pattern similarity is related to the symmetry of the antenna element. Preferably, all parts of the element should exhibit symmetry properties. This includes both patch and slot symmetries as radiation fields will derive from both the patch currents and the slot fields.

The pattern similarities also depend on the geometry of the patch. Patches with at least two orthogonal symmetry planes such as circular or square can be used since they reduce mutual coupling effects. Circular patches have the advantage of being less sensitive to for instance manufacturing tolerances with respect to rotational installation.

Figure 2:
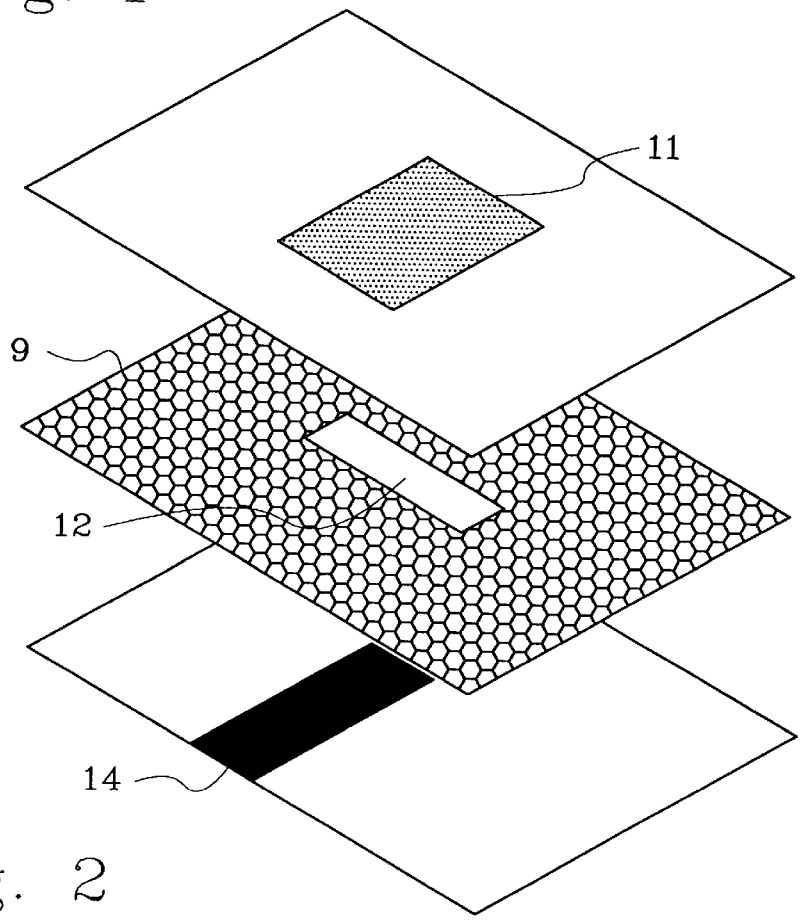
FIG. 2 shows the parts of a slot coupled microstrip patch element.

FIG. 2 shows the parts of a single polarised slot coupled microstrip patch element. This is intended to facilitate the comprehension of the following figures. As in FIG. 1, a patch is indicated by 11, a feed structure, in this case a slot, by 12 and the feed network by 14. As can be seen these three parts are located in different planes and the slot 12 is an aperture in a ground plane 9.

Where it in the description below says that any part of the feed network 14 enters the patch 11, this is only a way to facilitate the reading of the description. It should always be understood that the feed network 14 is in a plane of its own, separate from the plane belonging to the patch 11. Strictly speaking, where, in this context, it says "patch 11" it should usually be read "projection of said patch 11" and so on.

Figure 3:
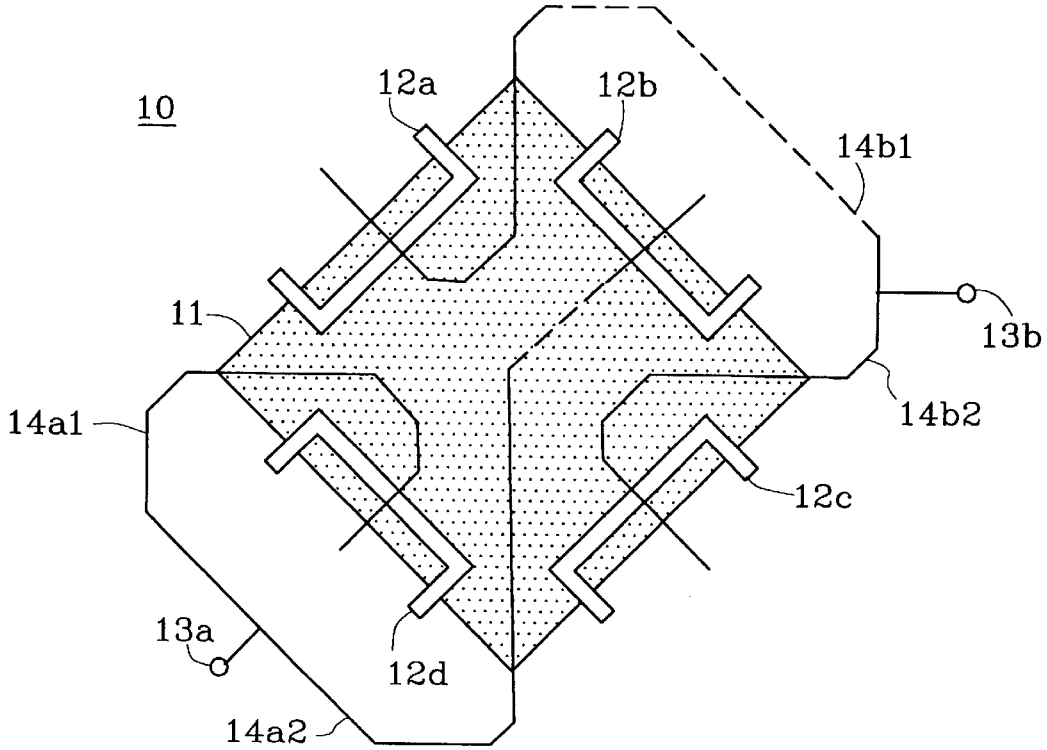
FIG. 3 shows a dual-polarised microstrip antenna element according to the invention.

FIG. 3 shows a possible embodiment of a dual-polarised microstrip antenna element according to the invention, a square slot-coupled microstrip patch antenna. In this figure, an antenna element 10 comprises a square patch 11. The patch 11 in this figure is planar, but non-planar patches can also be used. The antenna element also comprises a number of slots 12*a*–12*d* as feed structures. The staple-shaped slots 12*a*–12*d* are symmetrically arranged, one in the centre of each of the patch's 11 sides. At least parts of the legs of a staple usually protrude beyond the projection of the patch 11, while the overlying bar remains within the contour of the projection of the patch 11. The signals for the different polarisations are fed into the feed network 14 at the ports 13*a*, 13*b*. Each port 13*a*, 13*b* is connected to two opposing slots 12*a*–12*d*. In this figure, port 13*a* feeds slots 12*b* and 12*d*, while port 13*b* feeds slots 12*a* and 12*c*. As each port 13*a*, 13*b* feeds slots 12*b*, 12*d* and 12*a*, 12*c*, respectively, the feed network 14 divides into two branches from each port 13*a*, 13*b*. Port 13*a* is connected to branch 14*a*1 and 14*a*2, while port 13*b* is connected to branch 14*b*1 and 14*b*2. The branches 14*a*1, 14*a*2, 14*b*1, 14*b*2 all enter a projection of the patch close to a corner and leads further in on a diagonal or near-diagonal, in order to be equally distant from the nearest slots 12*a*–12*d* as the other branch 14*a*1, 14*a*2, 14*b*1, 14*b*2 belonging to the same network part 14*a*, 14*b*. After having entered the patch 11, the branches 14*a*1, 14*a*2, 14*b*1, 14*b*2 cross the center of the slots 12*a*–12*d* while conforming to the design rule of maintaining symmetry.

The dashed parts of the feed network 14 symbolise a change in phase of the signal 180 degrees effectively, with regard to the signal in the other branch of the same network part 14*a*, 14*b*. Here, and analogously elsewhere, it means that the phase also could be shifted for instance 540 or −180 degrees, as 0 and 360 degrees are equivalent. That is, the electric length of the dashed part is 180 degrees. For example, the signal running in branch 14*b*1 will be phase shifted 180 degrees compared to the dashed part of said branch 14*b*1. After said dashed part the signal will at least essentially have the same magnitude as the signal in the other branch 14*b*2, but the phases of the signals will be 180 degrees apart. The coupling between the slot 12*b* and the two branches 14*b*1 and 14*b*2 respectively will then have the same magnitude but will be 180 degrees out of phase. This results in a cancellation of the coupling effects, as summation of the two coupling components will cancel each other in slot 12*b*. This works analogously for the coupling components with slots 12*d* fed from the port 13*b*.

The above-mentioned 180 degree phase shift could, as is known in the art, be attained by line length differences or Shiffman phase shifters. The phase shift can be 180 degrees plus an integer times 360 degrees. Possible differences in signal strength in the two branches owing to transmission line losses can be compensated for if desired. Furthermore, the slot geometry can be chosen to conform with the current distribution on the patch. By using a shaped slot aperture and a non-uniform slot width, with the slot geometry matched to the current distribution on the patch, the overall electric properties of the patch and the slot as an entity are optimised for maximum performance.

Figure 4:
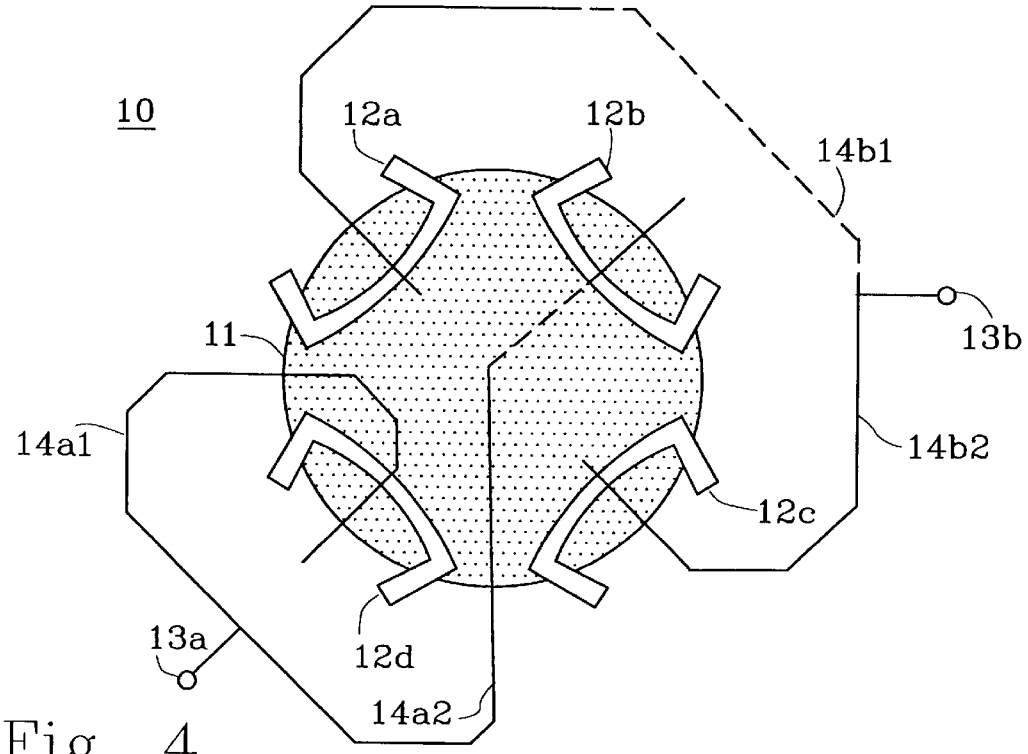
FIG. 4 shows another embodiment of a dual-polarised microstrip antenna element according to the invention.

FIG. 4 shows another embodiment of a dual-polarised microstrip antenna element according to the invention. In this figure, the ports 13*a*, 13*b*, and the two branches 14*a*1, 14*a*2 remain the same as in FIG. 3. The differences are the shape of the patch 11, the shape of the slots 12*a*–12*d*, and the layout of the branches 14*b*1, 14*b*2. The patch 11 is circular and slots 12*a*–12*d* are shaped like bent staples; the legs of the staple are straight while the overlying bar is bent. Said legs are positioned mainly outside the patch 11. The two branches 14*b*1, 14*b*2 are, conforming to the layout rules, arranged outside the patch until they cross the middle of the slots 12*a*, 12*c* from the outside leading in. The cancellation of coupling effects works as described for FIG. 3.

Figure 5:
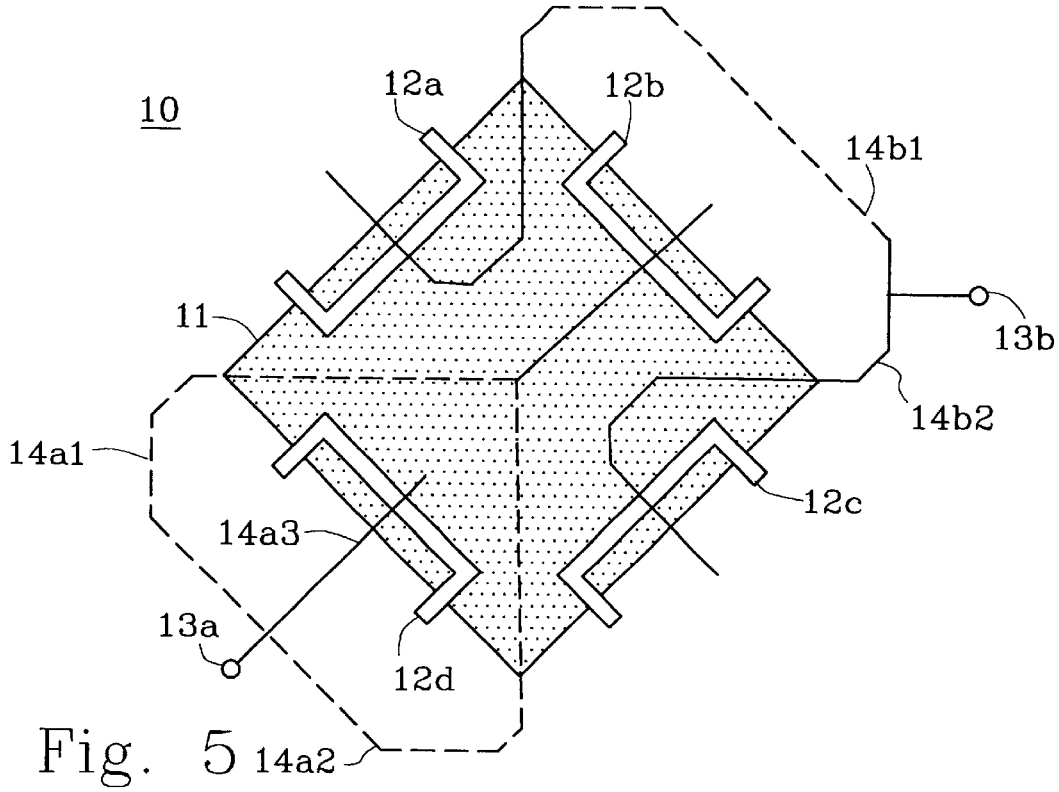
FIG. 5 shows yet another embodiment of a dual-polarised microstrip antenna element according to the invention.

FIG. 5 shows yet another embodiment of a dual-polarised microstrip antenna element according to the invention. As before, 10 indicates the antenna, 11 the patch, 12 the slots, 13*a*, 13*b* the ports, and 14 the feed network. The difference between this figure and FIG. 3 is the layout of the network part 14*a*, leading from port 13*a*. From said port 13*a*, positioned straight outside the centre of slot 12*d*, a branch 14*a*3 runs straight across said slot 12*d*. The other two branches 14*a*1, 14*a*2 run symmetrical with regard to a line intersecting the middle of slots 12*b* and 12*d*. Said branches 14*a*1, 14*a*2 surround slot 12*d* by running essentially parallel to its upper bar for a while, then turning to enter the patch 11 on the closest diagonals, intersecting in the middle of the patch 11, after which a single line crosses the opposite slot 12*b* from the inside out.

The dashed part of branches 14*a*1 and 14*a*2 shifts (relative to 14*a*3) the phase of the signal 360 degrees—or any integer times that. This will cause the signals in the branches 14*a*3 and 14*a*1, 14*a*2 to be in phase when crossing the slots 12*b* and 12*d*.

Figure 6:
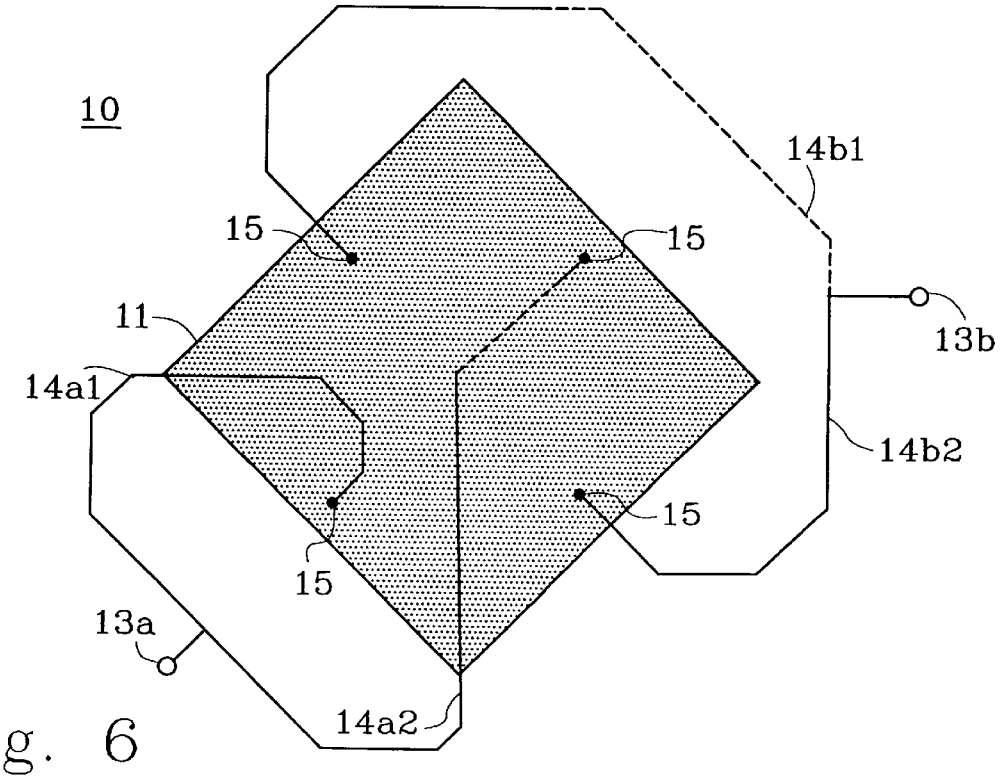
FIG. 6 shows one more embodiment of a dual-polarised microstrip antenna element according to the invention.

FIG. 6 shows one more embodiment of a dual-polarised microstrip antenna element according to the invention. As before, 10 indicates the antenna, 11 the patch, 13*a*, 13*b* the ports, and 14 the feed network. The differences between this figure and FIG. 3 are that there are no slots in the antenna 10 in FIG. 6, and that the layout of the feed network 14 is slightly different. Instead of slots, the feed structures comprise probes 15, for instance galvanic or capacitive, feeding through a ground plane (not shown). The feed network 14 in FIG. 6 is laid out so that the branches 14*a*1 and 14*a*2 end inside the patch 11. The other two branches 14*b*1 and 14*b*2 are shorter as well. All the branches 14*a*1, 14*a*2, 14*b*1, 14*b*2 end the same distance from the edges, in the centre of the sides of the patch 11, where they are connected to the probes 15.

Figure 7:
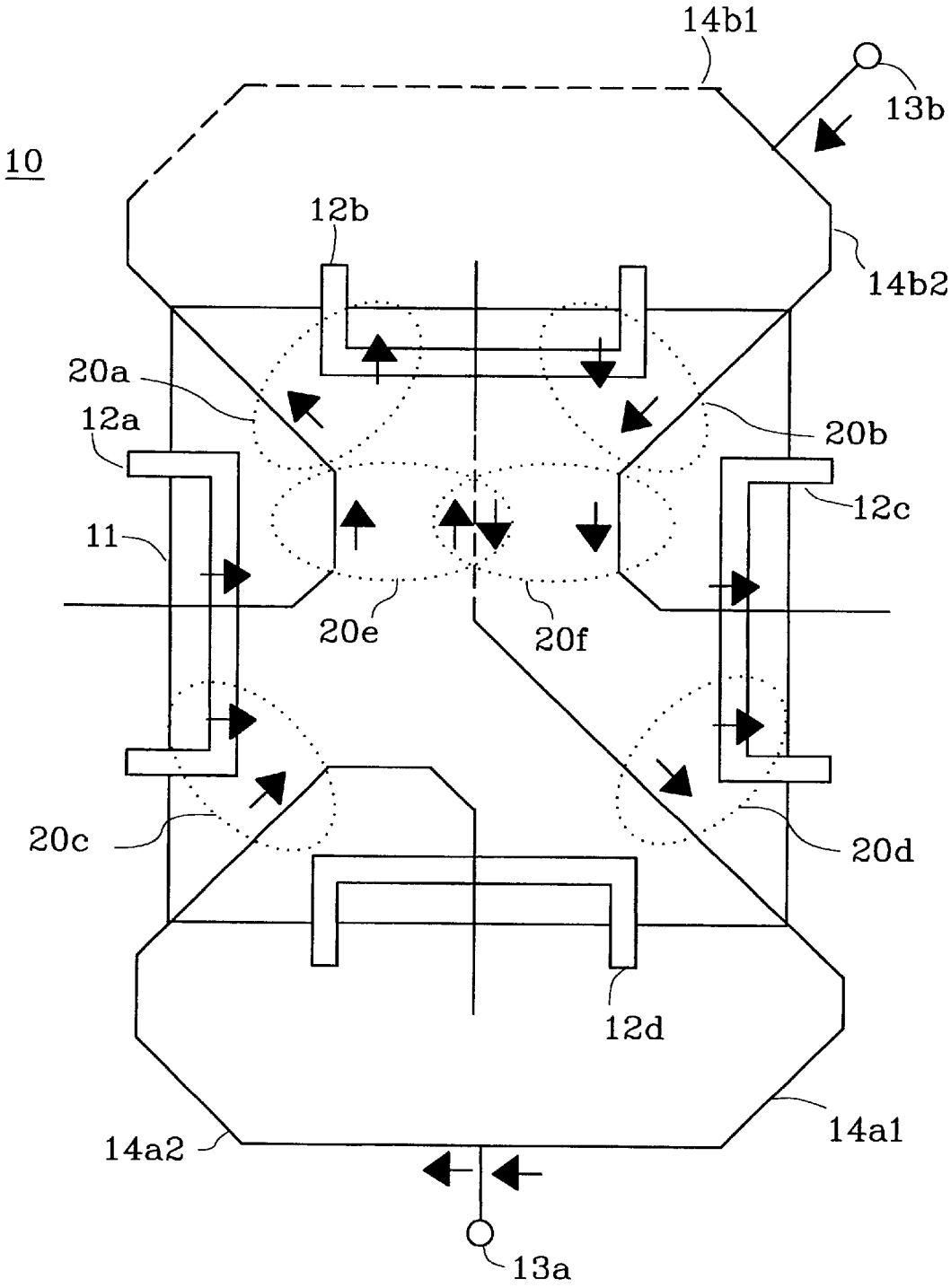
FIG. 7 illustrates an advantage with an embodiment of the dual-polarised microstrip antenna element according to the invention.

FIG. 7 illustrates the cancelling of coupling phenomena for the embodiment described in FIG. 3. New in this figure are six dotted ellipses 20*a*–20*f* representing regions of coupling fields and a number of arrows indicating the phase of currents and coupling fields. Assume that power is fed into the upper port 13*b*. Both branches 14*b*1 and 14*b*2 cause coupling components in the slot 12*b*, indicated by ellipses 20*a* and 20*b*. As part of branch 14*b*1 is designed to shift the phase of the signal 180 degrees, the coupling components cancel each other in the slot, as they have the same magnitude while being 180 degrees out of phase. Furthermore, the coupling between slots 12*a* and 12*c* and network part 14*a* cancel for the same reason at port 13*a*, indicated by ellipses 20*c* and 20*d*. Both branches 14*b*1, 14*b*2 cause coupling components at branch 14*a*1 indicated by ellipses 20*e* and 20*f*. Again, the coupling components cancel since the signals in branches 14*b*1 and 14*b*2 are 180 degrees out of phase. By reciprocity, the same cancelling effects will occur for signals from the other port, 13*a* at port 13*b*.

The cancellation effects in a probe-fed antenna element, FIG. 6, can be explained in a similar way as in FIG. 7 since the feed network 14 exhibit the same symmetry properties.

There is also provided a way (or method) of feeding two orthogonal polarisations. A benefit of this is that undesired coupling effects between polarisations are cancelled. This is achieved by using any of the embodiments of the apparatus according to the invention or any other combination of antenna parts that is essentially equivalent.

A possible field of application for the apparatus according to the invention is in an array antenna. This kind of antenna comprises many antenna elements, of which some or all can be of a kind described above.

The arrangement according to the invention is not necessarily limited to the way it was described or presented in the drawings, as they are intended to give an understanding of the general idea. The shape of the slots 12 could be different as long as the general idea is conformed with. Similarly, the layout of the feed network 14 is not restricted to the exact designs given above, but could vary to a certain extent, while retaining the fundamental symmetry characteristics described above. The thickness of the lines in the feed network 14 are not necessarily drawn to scale; but are drawn to facilitate comprehension.

What is claimed is:

1. A dual-polarised antenna element (10) comprising:

a patch (11), a ground plane (9), four feed structures (12*a*–12*d*, 15), two feed ports (13*a*, 13*b*), and a feed network (14), where the feed network (14) is divided into two separate network parts (14*a*, 14*b*) connected to a feed port (13*a*, 13*b*) each, where the four feed structures (12*a*–12*d*, 15) are symmetrically arranged, one pair for each polarisation, where the first of said two network parts (14*a*, 14*b*) is connected to one pair of said feed structures (12*a*–12*d*, 15) and the second of said two network parts (14*a*, 14*b*) is connected to the other one pair of said feed structures (12*a*–12*d*, 15), and where all network parts (14) reside in a single plane.

2. A dual-polarised antenna element (10) according to claim 1, where the feed structures (12*a*–12*d*, 15) are placed on two perpendicular lines passing through the projected centre of the patch (11).

3. A dual-polarised antenna element (10) according to claim 2, where each feed structure (12*a*–12*d*, 15) is located the same distance from said centre of the patch (11).

4. A dual-polarised antenna element (10) according to claim 2, where each feed structure pair (12*a*–12*d*, 15) is symmetrically placed with regard to any patch symmetry line.

5. A dual-polarised antenna element (10) according to claim 2, where at least part of each feed structure (12*a*–12*d*, 15) is in contact with the patch (11).

6. A dual-polarised antenna element (10) according to claim 1, where the patch (11) is a microstrip patch.

7. A dual-polarised antenna element (10) according to claim 1, where the patch (11) is planar.

8. A dual-polarised antenna element (10) according to claim 1, where the patch (11) is non-planar.

9. A dual-polarised antenna element (10) according to claim 1, where the patch (11) has at least two orthogonal symmetry planes.

10. A dual-polarised antenna element (10) according to claim 9, where the patch (11) is circular.

11. A dual-polarised antenna element (10) according to claim 9 where the patch (11) is square.

12. A dual-polarised antenna element (10) according to claim 1, where the feed structures (12*a*–12*d*, 15) are slots (12*a*–12*d*) in a ground plane (9).

13. A dual-polarised antenna element (10) according to claim 12, where the width of the slots (12*a*–12*d*) is non-uniform.

14. A dual-polarised antenna element (10) according to claim 12, where a geometry of the slots (12*a*–12*d*) conforms with the current distribution on the patch (11).

15. A dual-polarised antenna element (10) according to claim 1, where the feed structures (12*a*–12*d*, 15) are probes (15) feeding through a ground plane (9).

16. A dual-polarised antenna element (10) according to claim 15, where the probes (15) are galvanically connected to the patch (11).

17. A dual-polarised antenna element (10) according to claim 15, where the probes (15) are capacitively connected to the patch (11).

18. A dual-polarised antenna element (10) according to claim 1, where a first and second network part (14*a*, 14*b*) is structured so as to affect the pair of feed structures (12*a*–12*d*, 15) it is connected to, while its effect on the feed structures (12*a*–12*d*, 15) belonging to the other polarisation is cancelled.

19. A dual-polarised antenna element (10) according to claim 18, where the branches (14*b*1, 14*b*2) of a first network part (14*b*) are laid out so that they together are symmetrical around a projection of the line intersecting the middle of the feed structures (12*a*–12*d*, 15) belonging to the other polarisation, and that the difference in electric length between a point on a shorter branch (14*b*2) and its mirror point on a longer branch (14*b*1) is a minimum of 180 degrees from the point where said branch (14*b*2) enters the projection of the patch (11) onward, and where at least the major part of the second network part (14*a*) and the feed port (13*a*) feeding it are laid out symmetrically around a projection of the line on which the feed structures (12*a*–12*d*, 15) belonging to its own polarisation are arranged, and the feed port (13*a*), the straight lines in contact with the feed structures (12*a*–12*d*, 15), and the stretch of the branches (14*a*1–14*a*3) comprising the lines leading from the connection to the feed port (13*a*) to the lines leading into the patch (11), and where, in said second network part (14*a*), the electric distance between a point and its mirror point is zero degrees, while the feed structures (12*a*–12*d*, 15) are fed effectively in-phase such that the fields from both feed structures (12*a*–12*d*, 15) have the same magnitude and phase.

20. A dual-polarised antenna element (10) according to claim 19, where said second network part is arranged with symmetry, as a first branch (14*a*3) runs straight from the connection to the feed port (13*a*) to the nearest feed structure (12*d*, 15) or across the nearest feed structure, while the second and third branches (14*a*1, 14*a*2) run as mirror images of each other essentially orthogonal to said first branch (14*a*3) until they enter a projection of the patch (11) on a pair of radial lines between the nearest feed structure (12*d*, 15) and neighboring feed structures (12*a*, 12*c*, 15), continuing on said radial lines until they intersect in the centre of said projection of the patch (11) whereafter they run as a single line straight to the second feed structure (12*b*, 15) belonging to the polarisation.

21. A dual-polarised antenna element (10) according to claim 20, where the difference in electrical length between a point on the first branch (14*a*3) and a point on the other branches (14*a*1, 14*a*2) is 360 degrees where the two last branches (14*a*1, 14*a*2) have intersected and where the distances between above-said points and the feeding structures (12*b*, 12*d*, 15) are equal.

22. A dual-polarised antenna element (10) according to claim 20, where said radial lines are arranged so that the distances between a radial line and the nearest feed structures (12*a*–12*d*, 15) are equal.

23. A dual-polarised antenna element (10) according to claim 19, where a first branch (14*a*2) runs orthogonally with respect the symmetry line, until it turns to enter a projection of the patch (11) on a radial line between above-mentioned feed structure (12*d*, 15) and one of its neighbours (12*a*, 12*c*, 15), continuing to the centre of said projection, where said branch (14*a*2) turns to run straight to, and possibly across, the farther feed structure (12*b*, 15) belonging to the polarisation, while the second branch (14*a*1) mirrores the first branch (14*a*2) until said second branch has entered said projection of the patch (11) and has passed the point where the nearest feed structures (12*a*, 12*d*, 15) are closest to each other to a point roughly halfway between the point where the branch (14*a*1) entered the projection of the patch (11) and the middle of said projection where said branch (14*a*1) turns in order to, further on, run to, and possibly across, the closer feed structure (12*d*, 15) belonging to the polarisation.

24. A dual-polarised antenna element (10) according to claim 23, where said radial line is arranged so that the distances between the radial line and the nearest feed structures (12*a*–12*d*, 15) are equal.

25. A method of feeding current to two orthogonal polarisations in a dual-polarised antenna element (10) comprising:

feeding through four feed structures (12*a*–12*d*, 15), two for each polarisation, through a first and second network part (14*a*, 14*b*) so that the the current corresponding to one polarisation has no net effect on the feed current and the radiation pattern corresponding to the other polarisation, wherein all network parts (14) reside in a single plane.

26. A method for obtaining a dual-polarised antenna element (10) comprising a patch (11), four feed structures (12*a*–2*d*, 15), two feed ports (13*a*, 13*b*) and a feed network (14), where the feed network (14) is divided into two separate network parts (14*a*, 14*b*) connected to a feed port (13*a*, 13*b*) each, comprising the steps of:

arranging the four feed structures (12*a*–12*d*, 15) symmetrically, one pair for each polarisation, and connecting the first of said two network parts (14*a*, 14*b*) to one pair of said feed structures (12*a*–12*d*, 15) and connecting the second of said two network parts (14*a*, 14*b*) to the other one pair of said feed structures (12*a*–12*d*, 15), where all network parts reside in a single plane.

27. A method for obtaining a dual-polarised antenna element (10) according to claim 26, comprising the further step of placing the feed structures (12*a*–12*d*, 15) on two perpendicular lines passing through the projected centre of the patch (11).

28. A method for obtaining a dual-polarised antenna element (10) according to claim 27, comprising the further step of locating each feed structure (12*a*–12*d*, 15) the same distance from the projected centre of the patch (11).

29. A method for obtaining a dual-polarised antenna element (10) according to claim 27, comprising the further step of placing each feed structure pair (12*a*–12*d*, 15) symmetrically with regard to any patch symmetry line.

30. A method for obtaining a dual-polarised antenna element (10) according to claim 27, comprising the further step of placing at least part of each feed structure (12*a*–12*d*, 15) in contact with the patch (11).

31. A method for obtaining a dual-polarised antenna element (10) according to claim 26, comprising the further step of constructing feed structures (12*a*–12*d*, 15) by making slots (12*a*–12*d*) in a ground plane (9).

32. A method for obtaining a dual-polarised antenna element (10) according to claim 31, where the width of the slots (12*a*–12*d*) is non-uniform.

33. A method for obtaining a dual-polarised antenna element (10) according to claim 31, comprising the further step of matching the geometry of the slots (12*a*–12*d*) to the current distribution on the patch (11).

34. A method for obtaining a dual-polarised antenna element (10) according to claim 26, comprising the further step of constructing the feed structures (12*a*–12*d*, 15) with probes (15) feeding through a ground plane (9).

35. A method for obtaining a dual-polarised antenna element (10) according to claim 26, comprising the further step of structuring a first and second network part (14*a*, 14*b*) so as to affect the pair of feed structures (12*a*–12*d*, 15) it is connected to, while its effect on the feed structures (12*a*–12*d*, 15) belonging to the other polarisation is cancelled.

* * * * *